United States Patent [19]

Lindenschmidt

[11] 4,090,641

[45] May 23, 1978

[54] REFRIGERATOR ICE DOOR MECHANISM

[75] Inventor: Robert Edward Lindenschmidt, Evansville, Ind.

[73] Assignee: Whirlpool Corporation, Benton Harbor, Mich.

[21] Appl. No.: 718,146

[22] Filed: Aug. 26, 1976

[51] Int. Cl.[2] ..... B67D 5/06

[52] U.S. Cl. ..... 222/70; 221/15; 49/29; 62/344; 222/556

[58] Field of Search ..... 220/260; 222/70, 505, 222/556, 146; 221/15, 16, 12, 13, 154, 150, 247–250; 251/48, 49; 49/29, 30, 386; 141/360–362; 62/344

[56] References Cited

U.S. PATENT DOCUMENTS

| | | | |
|---|---|---|---|
| 2,697,918 | 12/1954 | Comstock | 62/345 |
| 2,957,607 | 10/1960 | Smith | 222/146 C |
| 3,548,444 | 12/1970 | Jacobus et al. | 16/78 |
| 3,572,053 | 3/1971 | Jacobus et al. | 62/344 |
| 3,640,088 | 2/1972 | Jacobus et al. | 62/344 |
| 3,942,334 | 3/1976 | Pink | 62/266 |

*Primary Examiner*—Stanley H. Tollberg
*Assistant Examiner*—H. Grant Skaggs
*Attorney, Agent, or Firm*—Wegner, Stellman, McCord, Wiles & Wood

[57] ABSTRACT

A refrigerator ice door mechanism having improved structure for controlling the outlet opening of a delivery chute provided for delivering ice pieces from an ice maker within the refrigerator to an access space in the front of the door. The closure is positively opened by operation of the ice dispenser actuating structure and is biased to a closed position substantially immediately after release of the actuating structure for terminating operation of the ice piece delivery structure, while permitting any remaining ice pieces moving through the ice delivery chute to move the closure away from the opening in passing to the access space. A time delay device is provided for applying a sealing force to the closure to positively close the opening a predetermined period of time subsequent to the release of the actuator and termination of the ice piece delivery.

12 Claims, 7 Drawing Figures

14
54
53
51
49
57
26
28a
28
56
58
33
39
66
65
18
64
40
63
30
41
43
60
62
61
44
42
19
27
15
31
21
17
28

37
48
38
65
38
39
65
40
66
36
34
35
36
47
51
53
47
50
52
51
50
49
28
28a
33
42
43
41
30
33
41
57
58
46
55
54
45
46
55
30
64
31
63
62
56
60
61

REFRIGERATOR ICE DOOR MECHANISM

BACKGROUND OF THE INVENTION

1. Field of the Invention

This invention relates to ice piece dispensers and in particular to means for controlling the closure of an ice delivery opening in an automatic ice piece dispenser.

2. Description of the Prior Art

In one form of ice piece dispenser, an ice piece maker is disposed within the freezer compartment of a refrigeration apparatus. The ice pieces are delivered to an access space in the front of the access door of the apparatus through a delivery chute receiving the ice pieces from the ice piece maker and deliverying them through the door to the access space.

It is conventional in such dispensing apparatus to effect the delivery operation by engagement of a receiving receptacle, such as a cup or glass, with an actuator mounted at the access space below the delivery chute opening so that when the receptacle is engaged with the actuator, the ice pieces are caused to be delivered downwardly thereinto, with the delivery operation continuing until the user withdraws the receptacle from engagement with the actuator.

The delivery chute conventionally defines an opening through the refrigeration apparatus insulative wall means. Thus, it is desirable to close the chute other than during the delivery operation. One such closure is illustrated in U.S. Pat. No. 2,697,918 of Alfred E. Comstock. In the apparatus disclosed therein, the closure comprises a pivoted flap which is swung to an open position by a plunger rod operated by a bell crank, in turn actuated by a flexible cable connected to a crank on the end of a timing shaft. Each cycle of operation, the cable is tensioned to operate the bell crank and shift the plunger outwardly to open the discharge flap. As shown in FIG. 3 of the Comstock patent, the closure rests against the port means in the closed arrangement thereof.

Another form of through-the-door ice dispenser is illustrated in U.S. Pat. No. 3,572,053 of Dwight W. Jacobus et al. The dispenser in this patent differs from that of the Comstock patent in that one or more springs are provided to bias the closure to its normally closed position. A time delay means is provided for keeping the closure open a few seconds after the actuator rod returns to its forward position as by removal of the receptacle from engagement therewith.

John J. Pink, in U.S. Pat. No. 3,942,334, shows a door delay closing mechanism for an ice chute from a power driven ice dispenser in a freezer-refrigerator. The chute door is closed by a spring-loaded means. When the door opening lever is released, an inertia motor delays closing of the door until the chute is emptied of ice. Thus, in each of the Pink and Jacobus et al structures, means are provided for preventing the immediate closing of the door to provide sufficient time for the last delivered pieces of ice to pass downwardly from the chute at the end of the delivery operation.

In copending application of Edwin M. Marks for U.S. Pat., Ser. No. 718,147, filed Aug. 26, 1976, which is owned by the assignee hereof, an improved structure for controlling the outlet opening is disclosed wherein the closure is biased to effectively continuously block the delivery opening against free air flow therethrough while yet permit opening thereof by ice pieces delivered through the chute.

SUMMARY OF THE INVENTION

The present invention comprehends an improved ice piece dispensing apparatus wherein the closure door is arranged to effectively immediately block the delivery opening upon release of the delivery means actuator while yet permit the subsequent reopening thereof by any remaining ice pieces being delivered through the chute.

The invention comprehends that the closure door be moved freely to the opening blocking position upon release of the actuator. In the illustrated embodiment, the closure door is gravity-biased to the blocking position.

In the blocking position, the closure door effectively prevents free flow of air inwardly through the chute into the freezer compartment as may occur in the prior art devices which maintain the closure door open for a preselected period of time after release of the actuator.

The ice piece dispensing apparatus of the present invention further includes means for effecting a sealing closure of the chute opening after a preselected delay period.

Thus, the present invention comprehends an improved dispensing apparatus wherein the delivery chute is effectively closed at all times other than when ice pieces are being delivered through the chute to effectively preclude undesirable delivery of warm air inwardly through the wall means defining the delivery chute to the ice maker compartment. The invention comprehends the effective closure of the chute opening releasably for a preselected delay period after release of the actuator and nonreleasably subsequent thereto until a reactuation of the dispensing means is effected.

The present invention represents an improvement over prior art devices in that closure of the chute opening will be effected even if the delay means fails to operate, thereby preventing an extended period of refrigerator operation during which warm room air can enter the freezing compartment by way of the open chute.

The effective minimizing of warm air delivery to the ice maker provides improved efficiency in the ice making operation and improved maintenance of the formed ice pieces as separate elements in the storage means thereof. As the mechanism permits the free delivery of the last ice pieces following release of the actuator, there is no need to delay closing of the chute opening to prevent jamming of such pieces as is required in the prior art devices.

Thus, the ice piece dispensing apparatus of the present invention is extremely simple and economical of construction while yet providing the improved ice piece dispensing functioning discussed above.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 4:
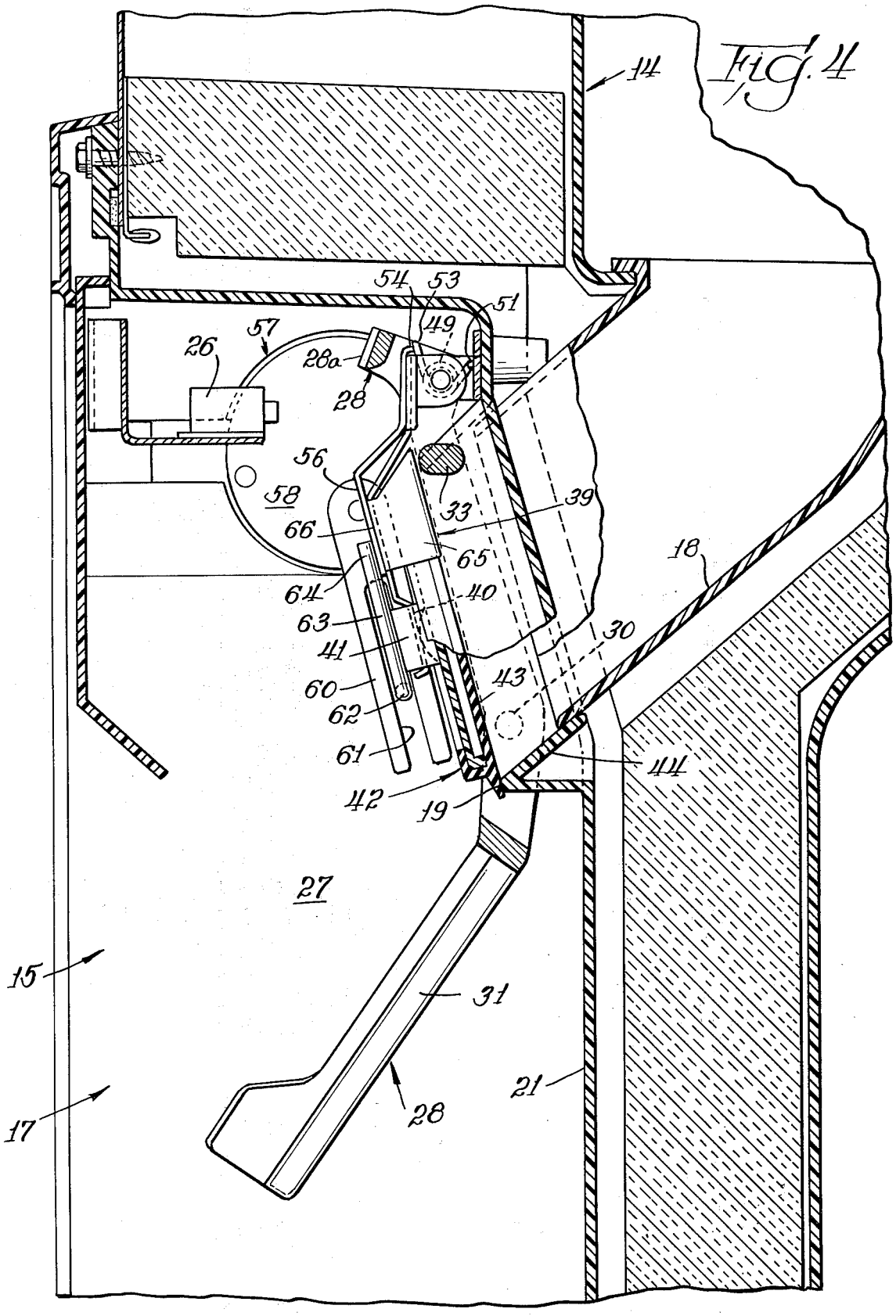
FIG. 4 is a fragmentary enlarged vertical section taken substantially along the line 4—4 of FIG. 3 illustrating the arrangement of the dispensing apparatus in the non-dispensing condition.

In the exemplary embodiment of the invention as disclosed in the drawing, a refrigeration apparatus generally designated 10 is shown to comprise a side-by-side apparatus having an above-freezing portion 11 and a freezer portion 12. Portions 11 and 12 are provided with suitable front doors 13 and 14, respectively. Freezer door 14 may be provided with a through-the-door dispensing means generally designated 15 including a refrigerated water dispenser 16 and an ice piece dispenser 17. As shown in FIG. 4, door 14 is provided with a downwardly, forwardly inclined delivery chute 18 defining an outer opening 19 through which ice pieces 20 (FIG. 5) may be dispensed in a controlled dispensing operation. Opening 19 is defined by a wall portion 44 of the rear wall 21 of the dispensing means 15 effectively defining a forward extension portion of the chute 18.

Figures 1, 2, 3:
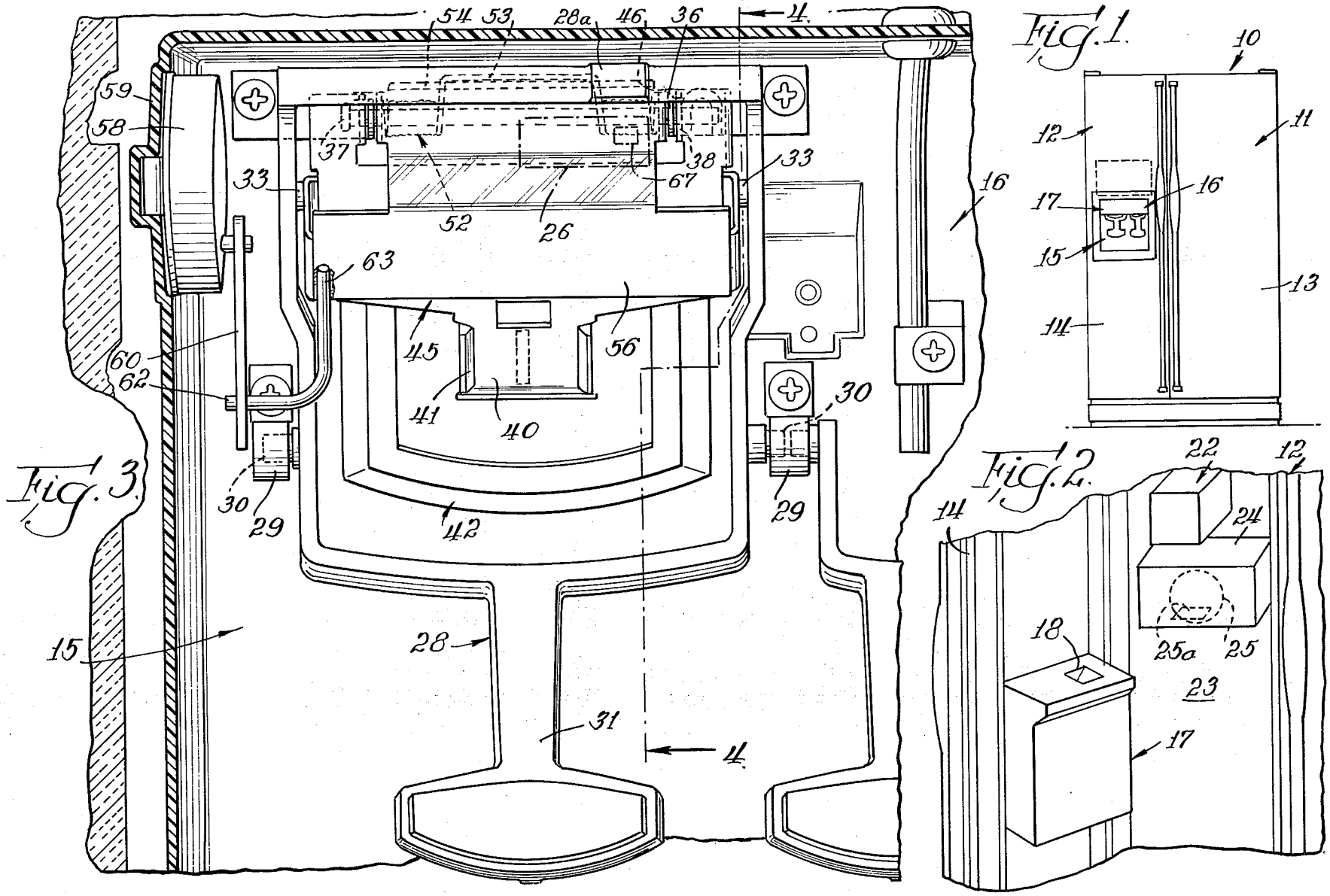
FIG. 1 is a front elevation of a refrigeration apparatus having an ice piece dispensing means embodying the invention.
FIG. 2 is a fragmentary perspective view illustrating the provision of the ice maker apparatus in the freezer compartment of the refrigeration apparatus and the mounting of the dispensing structure on the freezer door thereof.
FIG. 3 is a fragmentary enlarged front elevation of the dispensing structure in the access opening of the door.

As shown in FIG. 2, the ice pieces may be formed in an ice maker generally designated 22 mounted in the freezer compartment 23 of the freezer portion 12. The freezer compartment includes a collecting bin 24 which stores the ice pieces and delivery means 25 adjacent bin 24 for selective delivery to the dispensing means 15 through an outlet **25*a* opening into chute 18. Delivery means 25 is responsive to actuation by a switch 26 in the dispenser 17 to effect selective delivery of ice pieces from the delivery means 25 downwardly through chute 18 to the access space 27 defined by the dispensing means 15**.

Figure 5:
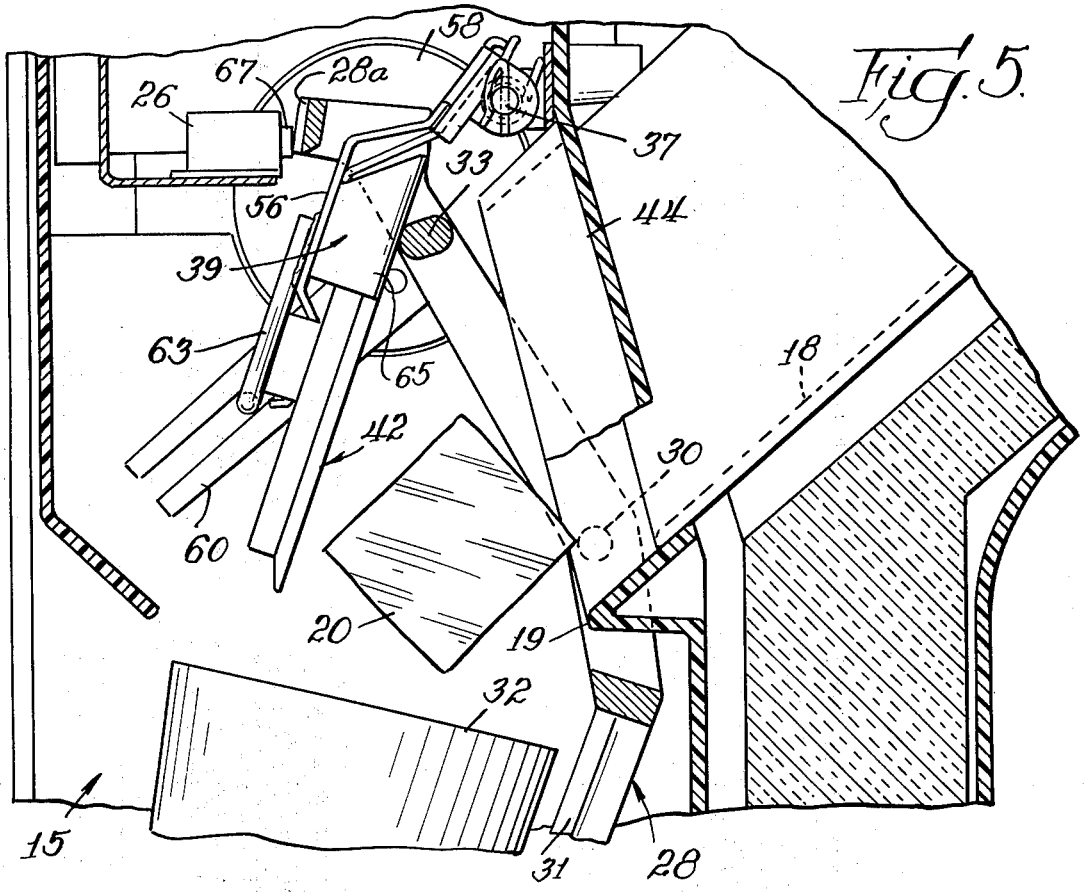
FIG. 5 is a fragmentary section similar to that of FIG. 4, but with the dispensing apparatus as arranged during the dispensing operation.

Switch 26, as illustrated in FIG. 5, is closed by the engagement of a shoulder portion **26*a* of an actuator 28 pivotally mounted to a pair of supports 29 by mounting means herein comprising a corresponding pair of pivots 30**.

Figure 7:
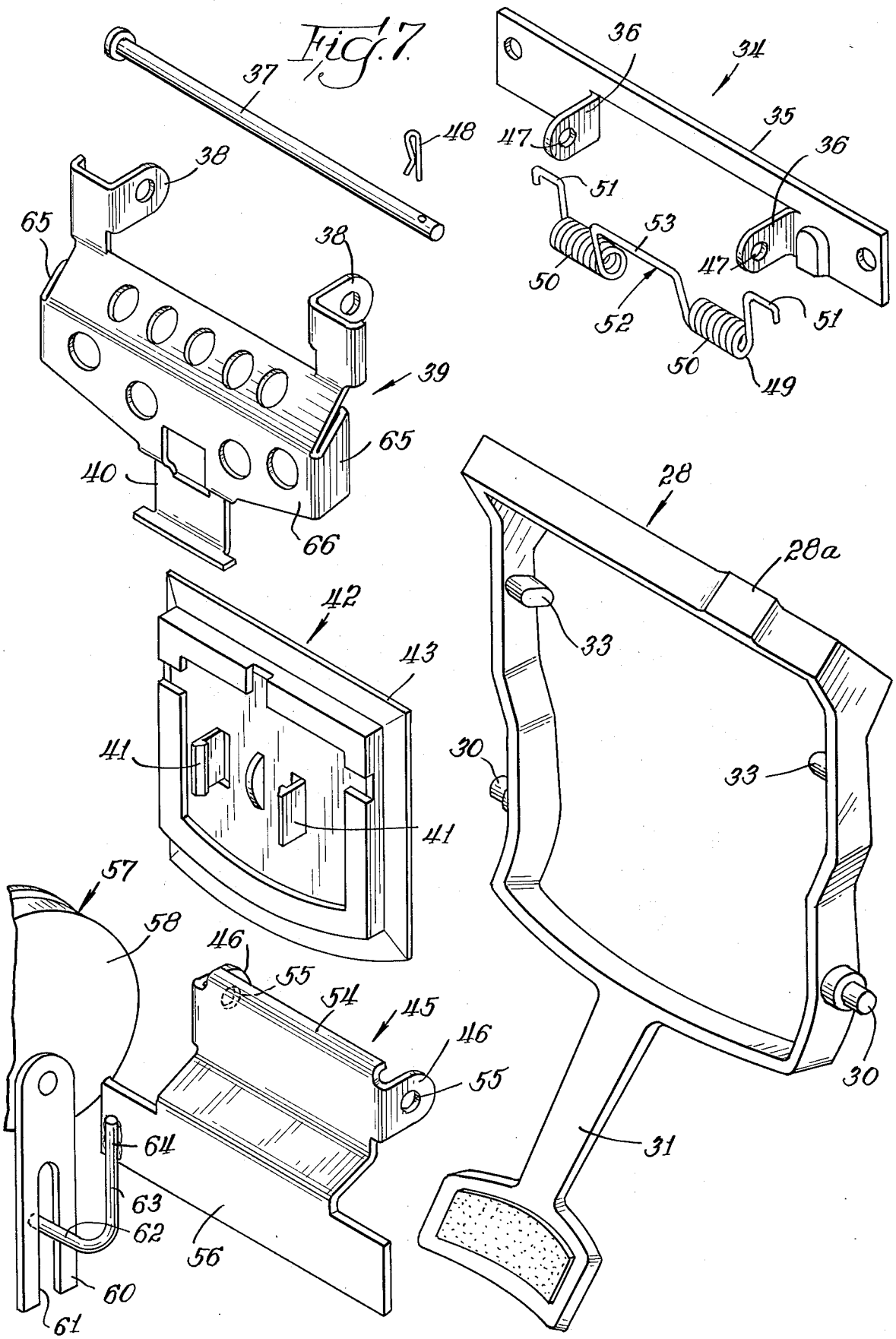
FIG. 7 is an exploded view of the closure mechanism.

As best seen in FIG. 7, the actuator further includes a lower tongue 31 adapted to be engaged by a receptacle, such as a cup or glass, 32 (see FIG. 5). The actuator further includes a pair of inwardly projecting lugs 33.

Actuator 28 forms a portion of a mechanism generally designated 34 which, in addition to providing means for automatically operating the control switch 26, also functions to provide a selective closing of the discharge chute opening 19 so as to prevent undesirable reverse warm air flow upwardly through the chute when the ice pieces are not being delivered downwardly therethrough. As shown in FIG. 7, mechanism 34 further includes a mounting bracket 35 adapted to be mounted to the rear wall 21 of dispenser 15 and provided with a pair of forwardly projecting lugs 36 adapted to support a mounting rod 37 which, in turn, is received in a pair of lugs 38 of a carrier 39 having a lower mounting portion 40 adapted to engage a mounting structure 41 of a closure generally designated 42. The closure includes a resilient pad portion 43 adapted to be sealingly engaged with the wall portion 44 defining the front opening 19 of chute 18 when the closure is in the sealingly closed position of FIG. 4. The carrier 39 and closure 42 are designed to be of light weight construction so that the impact of an ice piece against the rear surface of closure 42 is sufficient to open the closure, thereby allowing the ice piece to exit from chute 18.

Mechanism 34 further includes a follower generally designated 45 having a pair of lugs 46 pivotally mounted on rod 37. In the illustrated embodiment, lugs 38 of carrier 39 are disposed outwardly of lugs 36 on bracket 35 and lugs 46 of follower 45 are disposed inwardly thereof whereby the carrier 39 and follower 45 are coaxially pivotally mounted about the axis of rod 37. Rod 37 may be removably secured to extend through suitable openings 47 in lugs 36, by means of a spring fastener 48.

A force-applying means defined by a biasing spring 49 is provided with a pair of spaced helical portions 50 adapted to be mounted on rod 37 inwardly of the lugs 46 of follower 45. The opposite ends 51 of the spring define turned portions adapted to engage the bracket 35 and the midportion 52 of the spring comprises a U-shaped portion having a bight 53 adapted to be received in a semicylindrical lip 54 of the follower 45. As shown in FIG. 7, the lip 54 is above the axis of the opening 55 in lugs 46, and thus the spring 49 tends to pivot the follower in a counterclockwise direction, as seen in FIG. 7, so as to move a lower force-transmitting portion 56 of the follower rearwardly.

Conventional time delay means generally designated 57 are provided comprising a time delay housing 58 mounted to the side wall 59 of dispenser 15 (FIG. 3), and having a drive arm 60 provided with a slot 61 receiving the turned end 62 of a connecting rod 63 having an opposite end 64 affixed to the follower portion 56.

As further shown in FIG. 7, the carrier 39 is provided with a pair of side flanges 65. In the assembled arrangement of the mechanism 34, follower portion 56 overlies the midportion 66 of the carrier against which it is urged by the action of spring 49. Lugs 33 of the actuator 28 are adapted to engage the carrier flanges 65 when the actuator is pivoted on pivots 30 in a counterclockwise direction, as seen in FIG. 5, to urge the lugs 33 forwardly against the flanges 65 and, in turn, urge the carrier portion 66 against the follower portion 56. Forward movement of the follower portion 56, in turn, is transmitted through the connecting rod 63 to the time delay mechanism 57 so as to cock the mechanism by a clockwise swinging of the drive arm 60.

As the engagement between follower portion 56 and carrier portion 66 is readily separable, release of the actuator to permit the lugs 33 to return rearwardly, i.e., in a clockwise direction about the pivots 30, permits the carrier and closure 42 carried thereby to swing downwardly as by the gravity bias thereof notwithstanding a subsequent slow return of the follower 45 from the forward position under the controlled functioning of the time delay mechanism 57.

Thus, as seen in FIG. 4, in the normal nondispensing arrangement of dispensing means 15, the actuator 28 is arranged with the tongue 31 extending downward and forward, and the lugs 33 are disposed rearwardly to permit the closure 42 to be sealingly engaged with the wall portion 44 under the force-applying biasing action of spring 49.

Referring to FIG. 5, when a cup or similar receptacle 32 is urged rearwardly against the actuator tongue 31, the actuator pivots on pivots 30 in a counterclockwise direction as seen therein to urge the lugs 33 forwardly against the flanges 65 of carrier 39 swinging the carrier on rod 37 in a clockwise direction to, in turn, urge the follower portion 56 forwardly and cause connecting rod 63 to swing the timer arm 60 in a clockwise direction to cock the timer mechanism.

Concurrently, the actuator portion 28*a* engages the switch actuator 67 to suitably operate the switch 26 to effect delivery of ice pieces into chute 18 for delivery of the ice pieces 20 downwardly through the chute 18 and front opening 19 into the subjacent receptacle 32.

Figure 6:
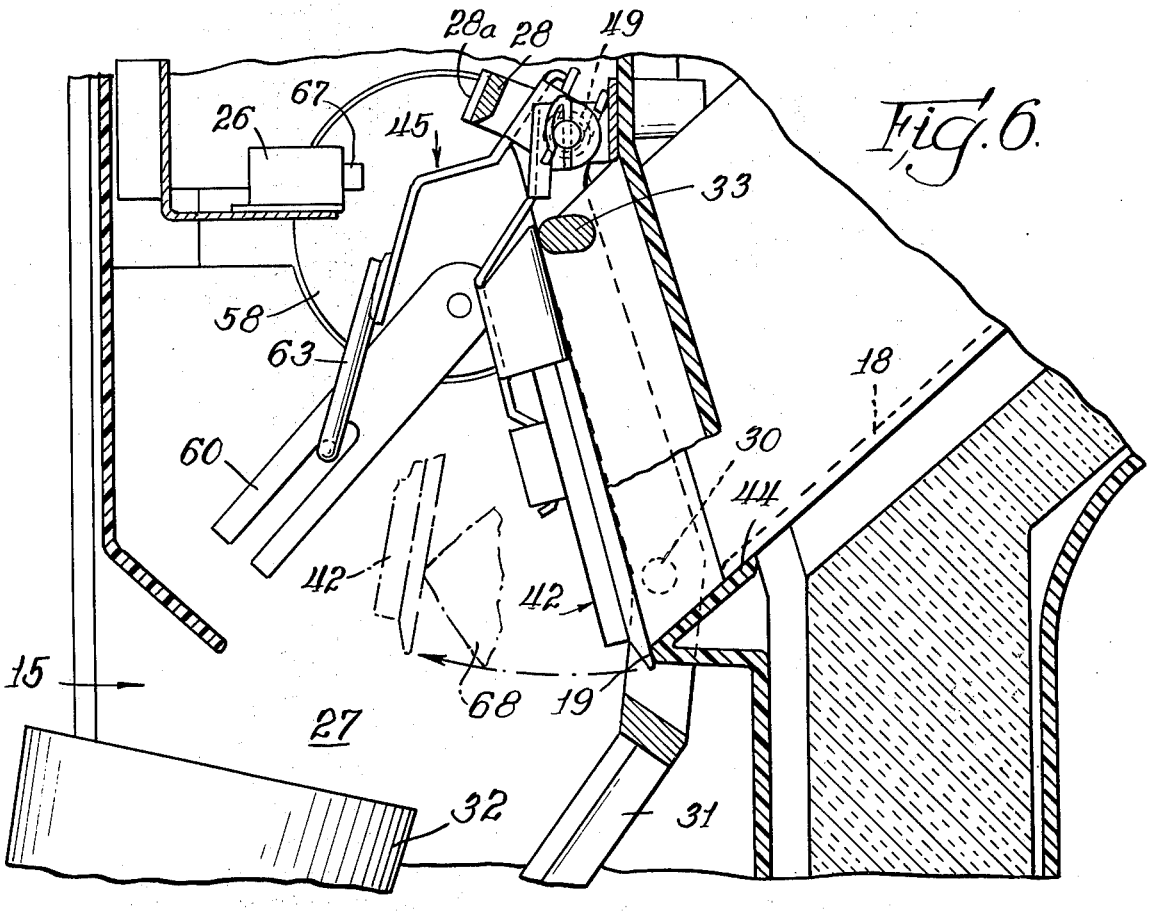
FIG. 6 is a vertical section similar to that of FIG. 5, but with the dispensing apparatus arranged in the chute-blocking position as immediately upon release of the actuator in full lines, and with the closure fragmentarily shown spaced from the chute opening to accommodate the passing of an ice piece from the delivery chute subsequent to the release of the actuator.

Upon removal of the receptacle from the actuator tongue 31, as shown in FIG. 6, the closure may swing immediately to a blocking position across the opening 19 notwithstanding the retention of the follower 45 forwardly thereof by the timer mechanism 57. Thus, any remaining ice pieces, such as ice piece 68 shown in broken lines in FIG. 6, may freely swing the closure 42 to an open position permitting the last ice pieces to be dispensed downwardly into the receptacle 32 before it is fully withdrawn from the access space 27. The free swinging of the closure by the ice pieces assures a proper delivery thereof into the receptacle notwithstanding its being moved forwardly from the access space at this time.

As soon as the last piece 68 passes to below the closure 42, the closure may again swing to the blocking position, shown in full lines in FIG. 6.

Delay mechanism 57 immediately starts moving the follower back toward the sealing position of FIG. 4 upon release of the actuator by driving the arm 60 in a counterclockwise direction, as seen in FIG. 6, back to the rearward position of FIG. 4. The delay mechanism is arranged to provide a preselected time period in effecting this movement so as to permit last minute ice pieces to be suitably dispensed prior to the forceful sealing engagement of the closure 42 with the opening wall means 44. As further shown in FIG. 6, the swinging of the closure by the ice piece 68 away from the blocking position is somewhat controlled so as to cause the closure 42 to deflect the ice piece rapidly downwardly into the cup 32 as it is being withdrawn to provide a further improved dispensing operation.

Resilient pad 43 of the closure 42 provides an effectively positive sealed closure of the opening 19 in the non-dispensing arrangement of the apparatus, as shown in FIG. 4. While the closure in the blocking position of FIG. 6 is not urged to the sealed condition by the spring 49, the closure effectively blocks reverse warm air flow upwardly through the chute 18 at this time so that the chute is open to atmosphere only during such times as when ice pieces are being dispensed. Thus, minimum warm air flow into the freezer compartment 23 occurs in the automatic dispensing of the ice pieces by dispenser 15 to provide an improved functioning of the refrigeration apparatus 10 as discussed above.

In the illustrated embodiment, the closure is gravity-biased to the blocking position of FIG. 6. As will be obvious to those skilled in the art, the closure may be suitably spring biased to provide a releasable blocking of the chute opening 19 if desired.

Another advantage of the present structure is the fail-safe arrangement of the closure which effectively assures a closing of the chute notwithstanding a failure of operation of the time delay mechanism.

Closure 42 thusly defines an improved ice chute door which is effectively positively opened by the actuator means of the apparatus. The door is gravity-biased to a blocking position to effectively close the chute upon release of the actuator but is designed to be lightweight so as to permit any remaining ice pieces to freely move the door away from the blocking position to permit these ice pieces to also be dispensed into the cup or glass as it is being withdrawn from the actuator. The closure is arranged to be effectively positively closed after a preselected period of time to provide further improved sealed closure of the freezer compartment in the normal non-dispensing arrangement of the apparatus.

The foregoing disclosure of specific embodiments is illustrative of the broad inventive concepts comprehended by the invention.

Having described the invention, the embodiments of the invention in which an exclusive property or privilege is claimed are defined as follows:

1. In an ice piece dispensing apparatus having means defining an opening through which ice pieces are sequentially delivered in a dispensing operation, the improvement comprising: a closure mounted adjacent said opening and being biased to a position wherein said closure effectively blocks said opening; actuator means; means for mounting said actuator means adjacent said closure for movement between a released position and an actuating position; means for moving said closure to an open position away from said opening to permit free delivery of ice pieces through said opening as an incident of said actuator means being moved from said released position to said actuating position, and permitting said closure to be biased to said blocking position substantially immediately upon release of actuator means; and time delay means for subsequently urging said closure into a sealed closed relationship with said opening means a preselected period after said release of the actuator means.

2. The ice piece dispensing apparatus of claim 1 wherein said closure is freely swingably mounted.

3. The ice piece dispensing apparatus of claim 1 wherein said time delay means includes a follower urged to a retracted disposition as an incident of said actuator means being moved to said actuating position and applying sealing force to said closure after said preselected period.

4. The ice piece dispensing apparatus of claim 1 wherein said closure is gravity-biased to close said opening in the blocking position.

5. The ice piece dispensing apparatus of claim 1 wherein said closure is mounted to a pivotally mounted carrier adapted to be engaged by said actuator to move said closure to said open position as an incident of said actuator means being moved to said actuating position.

6. The ice piece dispensing apparatus of claim 1 wherein said closure is mounted to a pivotally mounted carrier adapted to be engaged by said actuator to move said closure to said open position and engageable with said time delay means to dispose said time delay means in a retracted disposition as an incident of said actuator means being moved to said actuating position.

7. The ice piece dispensing apparatus of claim 1 wherein said time delay means includes a spring biasing means for biasing said closure into said sealed closed relationship with said opening defining means, and time delay means for delaying the application of the spring biasing means force to the closure in the blocking position.

8. The ice piece dispenser apparatus of claim 1 wherein said closure is constructed and disposed such that it moves by gravity to said blocking position immediately upon release of said actuator, permitting an ice piece passing through said opening to remove said closure momentarily from said blocking position during said preselected period.

9. In an ice piece dispensing apparatus having means defining an opening, comprising: closure means; delivery means selectively operable to cause sequential delivery of ice pieces through said opening; actuator means for energizing said delivery means and causing said closure to move away from said opening, said closure means being biased so that immediately upon release of said actuator means the closure means tends to block the opening substantially against free air flow therethrough while permitting ice pieces to move the closure means away from the opening to permit dispensing thereof; force-applying means for urging said closure means sealingly across said opening; and time delay means permitting said force-applying means to urge said closure sealingly across said opening only after a predetermined period of time subsequent to release of said actuator means.

10. The ice piece dispensing apparatus of claim 9 wherein said biasing means comprising means for gravity biasing the closure means to block said opening.

11. The ice piece dispensing apparatus of claim 9 wherein said force-applying means comprises a follower which engages said closure, and said apparatus includes means for urging said follower to a retracted position concurrently with the movement of said closure away from said opening.

12. The ice piece dispensing apparatus of claim 9 wherein said force-applying means comprises a follower which overlies said closure and spring means biasing said follower to bias said closure means to sealingly close said opening, and said actuator includes means for urging said closure to an open position said closure engaging said follower and urging same to a retracted position against the action of said spring means concurrently with the energization of said delivery means, said force-applying means further including time delay means for delaying biasing of the follower by the spring means to urge the closure means sealingly across said opening for said preselected period after release of the actuator means.

* * * * *